US006026916A

United States Patent [19]

Briese

[11] Patent Number: 6,026,916

[45] Date of Patent: Feb. 22, 2000

[54] ROTARY DRILL ARRANGEMENT

[75] Inventor: Leonard Arden Briese, Harbor City, Calif.

[73] Assignee: Briese Industrial Technologies, Inc., Harbor City, Calif.

[21] Appl. No.: 08/905,031

[22] Filed: Aug. 1, 1997

[51] Int. Cl.[7] ..... E21B 10/14; E21B 10/28; E21B 10/46

[52] U.S. Cl. ..... 175/336; 175/353; 175/365; 175/385; 175/426

[58] Field of Search ..... 175/336, 353, 175/351, 365, 392, 386, 385, 421, 426

[56] References Cited

U.S. PATENT DOCUMENTS

| | | | |
|---|---|---|---|
| Re. 23,416 | 10/1951 | Kinnear | 175/336 |
| 191,241 | 5/1877 | Kimball . | |
| 972,969 | 10/1910 | Wittich . | |
| 1,029,491 | 6/1912 | Cortinas | 175/379 |
| 1,238,707 | 8/1917 | Bardeen . | |
| 1,387,733 | 8/1921 | Midgett | 175/385 |
| 1,438,876 | 12/1922 | Thomas . | |
| 1,542,007 | 6/1925 | Schroeder . | |
| 1,577,952 | 3/1926 | Carnegie . | |
| 1,692,919 | 11/1928 | Bailey . | |
| 1,723,381 | 8/1929 | Seifert . | |
| 1,747,908 | 2/1930 | Seifert . | |
| 1,790,613 | 1/1931 | Gildersleeve et al. . | |
| 1,812,475 | 6/1931 | Gildersleeve et al. . | |
| 1,858,744 | 5/1932 | Lunsford | 175/385 |
| 2,054,311 | 9/1936 | Adams . | |
| 2,198,849 | 4/1940 | Waxler | 175/336 |
| 2,860,855 | 11/1958 | Vincent . | |
| 2,862,286 | 12/1958 | Williams . | |
| 2,886,293 | 5/1959 | Carr et al. . | |
| 3,049,033 | 8/1962 | Benjamin et al. . | |
| 3,103,736 | 9/1963 | Ortman . | |
| 3,106,972 | 10/1963 | Thornsberry . | |
| 3,163,246 | 12/1964 | Vagins et al. . | |
| 3,262,184 | 7/1966 | Sweeny . | |
| 3,434,553 | 3/1969 | Weller . | |
| 3,759,625 | 9/1973 | Iversen . | |
| 3,765,496 | 10/1973 | Flores et al. . | |
| 4,047,826 | 9/1977 | Bennet . | |
| 4,086,972 | 5/1978 | Hansen . | |
| 4,093,392 | 6/1978 | Hopkins . | |
| 4,190,125 | 2/1980 | Emmerich et al. . | |
| 4,215,955 | 8/1980 | Lillie . | |
| 4,381,162 | 4/1983 | Hosoi . | |
| 4,477,211 | 10/1984 | Briese . | |
| 4,511,006 | 4/1985 | Grainger . | |
| 4,610,317 | 9/1986 | England et al. . | |
| 4,614,463 | 9/1986 | Hughes . | |
| 4,621,955 | 11/1986 | Briese . | |
| 4,627,503 | 12/1986 | Horton . | |
| 4,645,386 | 2/1987 | Smith . | |
| 4,648,760 | 3/1987 | Karlsson et al. . | |
| 4,682,916 | 7/1987 | Briese . | |
| 4,733,735 | 3/1988 | Barr et al. . | |
| 4,733,995 | 3/1988 | Aebi . | |

(List continued on next page.)

FOREIGN PATENT DOCUMENTS

| | | |
|---|---|---|
| 776939 | 11/1934 | France . |
| 713504 | 10/1941 | Germany . |
| 523761 | 10/1976 | U.S.S.R. . |
| 607660 | 5/1978 | U.S.S.R. . |
| 607770 | 9/1948 | United Kingdom . |
| 2057939 | 4/1981 | United Kingdom . |

OTHER PUBLICATIONS

Leonard A Briese—Jul. 1996 "Harts Petroleum Engineer International", Disc Cutter Bits Offer Potential Penetration Rates, p. 11.

*Primary Examiner*—Hoang Dang
*Attorney, Agent, or Firm*—Don Finkelstein

[57] ABSTRACT

A rotary drill arrangement comprising a combination spade drill body having a rotational axis, a shank portion, and a generally planar spade cutter portion with a pair of oppositely directed cutting edges extending radially of the axis, and a rotatable frusto conical cutter mounted on the spade cutter portion adjacent the maximum radial extent of each cutting edge.

17 Claims, 3 Drawing Sheets

U.S. PATENT DOCUMENTS 4,751,972 6/1988 Jones et al. .
4,796,713 1/1989 Bechem et al. .
4,817,742 4/1989 Whysong .
4,819,748 4/1989 Truscott .
4,893,967 1/1990 Briese .
4,936,719 6/1990 Peters .
4,940,369 7/1990 Aebi et al. .
4,946,318 8/1990 David et al. .
4,984,944 1/1991 Pennington, Jr. et al. .
4,993,888 2/1991 Briese .
5,028,175 7/1991 Pawlik .
5,038,859 8/1991 Lynde et al. .
5,061,127 10/1991 Thomas ..... 408/212
5,099,929 3/1992 Keith et al. .
5,103,922 4/1992 Jones .
5,160,232 11/1992 Maier .
5,213,171 5/1993 Clench et al. .
5,220,967 6/1993 Monyak .
5,226,489 7/1993 Woods et al. .
5,287,937 2/1994 Sollami et al. .
5,291,806 3/1994 Bothum ..... 76/102
5,311,959 5/1994 Adams .
5,363,932 11/1994 Azar .
5,429,199 7/1995 Sheirer et al. .
5,433,281 7/1995 Black .
5,456,329 10/1995 Dennis et al. .
5,458,210 10/1995 Sollami .
5,458,211 10/1995 Dennis et al. .

ROTARY DRILL ARRANGEMENT

BACKGROUND OF THE INVENTION

1. Field of the Invention

The present invention relates to the field of rotary drills, and in particular to a rotary drill arrangement with improvement features which greatly extend the life of a rotary drill of the type having a blade with transverse cutting edges extending from a central portion of the drill tip radially outwardly.

2. Brief Description of the Prior Art

Drills adapted to bore through rock are well known and documented in the art. For example, drills for the installation of roof bolts in mines and the like have a hardened tungsten carbide blade mounted transversely on the distal end of an elongated drill shank. The body of the drill may also have access ports communicating with the interior of the bore for purposes of flowing water or applying a vacuum to remove dust and cuttings from the vicinity of the cutting action in the bore. The blades of such drills are adapted to bore a hole having a diameter of approximately one inch and larger into the hardened stone roof or earth strata of the walls of a mine.

In the distant past, it was common to forge a drill from hardened material or substance such that the distal end of the drill was shaped in a generally planar spade-like configuration with transverse cutting edges leading from a central point of the drill to the outer periphery of a cutting circle which the drill makes in the material or substance to be drilled.

An improvement of that basic structure has been proposed in the prior art in the form of attaching a spade drill blade in a slot at the distal end of a drill body by brazing or by some sort of a fastener. This permits the spade-like blade to be made of a hardened material or substance, while the drill body may be made of a softer, less expensive, material.

The blades of such drills are subjected to extreme forces causing stresses within the blade which frequently result in breakage of the blade and failure of the drill, and in particular, causes wear especially at the outer radial portions of the cutting edge of the blade insert. Such wear is caused by a number of factors, including improper alignment of the blade on the distal end of the drill body, excessive thrust being applied to the blade during the drilling operation, heat generated by the fact that the cutting edge of the spade insert is, at all time, in contact with the material or substance being drilled without any opportunity for cooling. Abrasion, frictional, and impact wear are also major causes of drill failure.

Attempts have been made in the past to achieve the goals of the present invention, but their efforts have fallen short of providing satisfactory results. For example, U.S. Pat. Nos. 5,287,937 and 5,458,210 to Sollami et al. show a drill with a blade insert having features which serve to centrally locate the cutting blade in the longitudinal recess of a drill body, but the cutting edges of the insert are of traditional shape and are thus subject to traditional wear and damage as described above.

Other examples of providing a spade blade insert into a receiving drill body can be found by reference to U.S. Pat. No. 4,086,972 to Hansen et al.; U.S. Pat. No. 4,817,742 to Whysong; U.S. Pat. No. 4,819,748 to Truscott; and U.S. Pat. No. 3,049,033 to M. L. Benjamin et al. While all of these prior art patents relate to spade drill insert arrangements, and while suggested improvements in blade cutting edge design and attachment means between the blade and the body of the drill are offered, none of these prior art references suggest any solution for the problem of wear of the cutting edges of a spade drill, especially toward the outer radial surfaces thereof.

U.S. Pat. No. 4,627,503 to Horton attempts to solve the wear problem by providing a multi-layer spade cutting insert comprising a polycrystalline diamond center layer portion and outer metal side portions. When used as an insert in a spade drill, the cutting element, while extending the life of the drill due to the presence of the polycrystalline material, the cutting edges must nevertheless be repeatedly resharpened, as mentioned in this prior art patent. Polycrystalline tool materials are very delicate and are very subject to impact chipping and breakage.

Attempts have also been made in the prior art to employ rotating discs to assist in the cutting action of a drill, examples being found in U.S. Pat. No. 1,692,919 to W. C. Bailey, and U.S. Pat. Nos. 1,790,613 and 1,812,475 to A. M. Gildersleeve et al. However, the rotary cutting discs as described in these prior art patents define the cutting edges of the drill devices themselves, i.e. they are not associated with any other drill cutting edges in combination.

It would be desirable to provide an improved rotary drill arrangement which puts the cutting edges at exact alignment locations without brazing or the possibility of an inadvertently loosened screw or other fastener which may cause damage, not only to the spade drill insert but also to the body of the drill and possibly to the drill driving apparatus. It would also be desirable to provide a rotary drill arrangement which would reduce cutting forces for the same rate of cut to thereby reduce the required thrust bearing forces, and to reduce the incidences of failure of the drill by extending the life of the drill several times over the life of a standard transverse edge spade drill arrangement.

SUMMARY OF THE INVENTION

The present invention overcomes the aforementioned problems and disadvantages with the prior art drill devices by providing a rotary spade drill arrangement comprising a combination spade drill body having a rotational axis, a shank portion, and a generally planar spade cutter portion with a pair of oppositely directed cutting edges extending radially of the axis. A rotatable frusto conical cutter is mounted on the spade cutter portion adjacent the maximum radial extent of each cutting edge. In a preferred embodiment, the spade cutter portion comprises a spade insert mounted to the shank portion.

The zero plane of the frusto conical cutter cutting edges are made coincident with the plane of the cutting paths of the spade cutter insert cutting edges adjacent the maximum radial extent of the spade cutter insert edges. In this way, the cutting edges of the rotatable frusto conical cutters cut material or substance which would otherwise be cut by the most extreme radial cutting edge of the spade insert.

Since the frusto conical cutter is rotatable, and since the forces applied to the face of the frusto conical cutter during a cutting action tend to rotate the cutter, a fresh portion of the cutting edge is always presented at the maximum radial extent of the spade insert. This not only provides for a greatly extended life of the cutting edge at the extreme radial ends of the spade cutter by exposing the material or substance to be cut with a continuously fresh cutting edge, but due to the rotation of the frusto conical cutter, the cutting edge making a cut is immediately rotated out of position so as to have time to cool before it is brought back into cutting engagement with the material or substance to be cut. Both of these features of a rotatable frusto conical cutter greatly increase the life of the rotary spade drill arrangement.

Another major feature of the invention is that it forms a true constant diameter hole over the life of the spade drill. With prior art spade drills, the forward portion of the side edges of the cutter wear faster than those at the rearward portion. As a result, the spade cutter becomes tapered, making a tapered hole due to such drill wear, and drill seizure in the tapered hole often results. The cutting edge of a conical skirt in a frustum cutter, as in the present invention, performs as a reamer maintaining a true constant diameter hole and avoiding seizure.

Other important features include reduced frictional, abrasive, and impact wear or chipping, reduced heat, higher rotating speeds, higher feed rates, and higher productivity rates.

Thus, the present invention provides the advantages of a frusto conical cutter in combination with the ideal spade drill insert arrangement for drilling holes in stone, metal, or other hard substances. As compared with the common transverse spade drill cutting insert, the addition of a rotatable frusto conical cutter mounted on the spade cutter portion adjacent each cutting edge results in stronger cutting edges, less thermal deformation, greater heat dissipation, heavier feeds, more efficient cutting action, reduced horsepower of the driving force, reduced part deflection, reduced entry shock, reduced cutting forces, more stability and positive mounting position of the cutting edges of the rotary spade drill arrangement, and improved surface finishing when used for surfacing work-hardened materials or substances.

BRIEF DESCRIPTION OF THE DRAWING

Further objects and advantages and a better understanding of the present invention may be had by reference to the following detailed description taken in conjunction with the accompanying drawings in which.

DETAILED DESCRIPTION OF THE PREFERRED EMBODIMENTS

Figure 1:
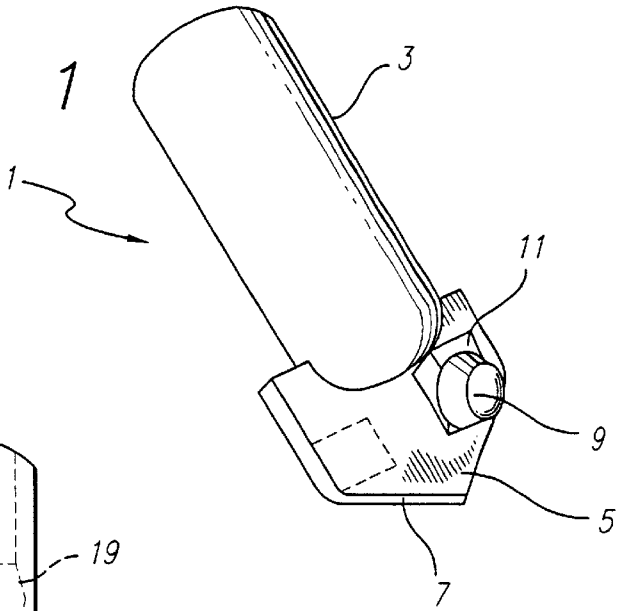
FIG. 1 is a perspective view of a basic spade drill employing a rotatable frusto conical cutter on the blade insert portion thereof.

FIG. 1 shows a basic rotary spade drill arrangement 1 having a shank portion 3 and a spade cutting insert 5 fixed to the distal end of shank 3. The spade cutting insert 5 is shown to have radially directed cutting edges 7 slanted rearwardly toward the outer periphery of the insert 5. On the flat surfaces of spade cutting insert 5, at the furthest radial location, is positioned or formed a platform, or boss, 11 supporting a rotatable frusto conical cutter insert 9. This depiction of the most basic aspect of the present invention, nevertheless, provides the aforementioned advantages, greatly prolonging the life of the spade cutting insert 5 for the reasons mentioned.

Figure 3:
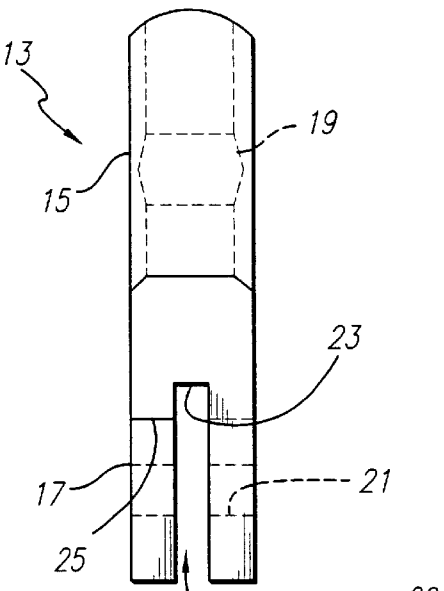
FIG. 3 is a right side elevational view of the female body and shank portion shown in FIG. 2.
Figure 5:
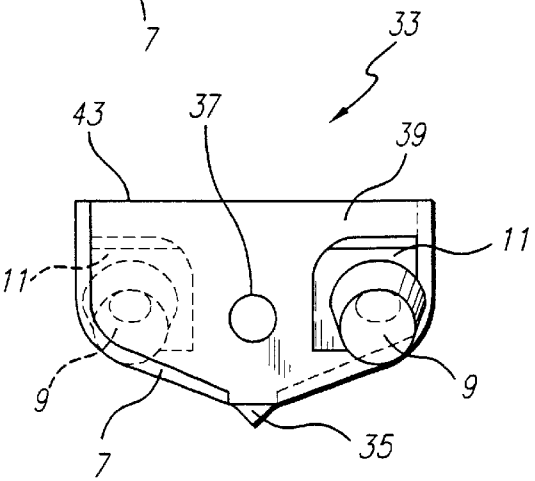
FIG. 5 is a spade blade insert showing a rotatable frusto conical cutter mounted outwardly on both sides of the spade insert.

FIGS. 2–5 show a preferred embodiment of the invention in which a body and shank member 13 (FIG. 2) accepts and securely holds a spade cutting insert 33 (FIG. 5). The body and shank member 13 is comprised of a shank portion 15 and a female insert receiver portion 17. As best seen in FIG. 3, the insert receiver portion 17 has a slot 29 traversing the insert receiver portion 17 along its entire width, the slot 29 ending in a bottom wall 23.

The spade cutting insert 33 is received in slot 29 in a predetermined snug fit, and a rivet 41 (FIG. 7) is passed through hole 21 in insert receiver portion 17 and hole 37 in spade cutting insert 33.

In order to accommodate the rotatable frusto conical cutting inserts 9, a cutaway portion 25 is provided at the bottom, or outer end of body and shank member 13, the cutaway portion 25 being provided only in the area of the platform 11 and cutter insert 9 projecting from each side of spade cutting insert 33.

When spade cutting insert 33 is positioned in slot 29, and rivet 41 is secured in place, the upper linear machined surface 43 of the spade cutting insert 33 surface contacts the machined bottom wall 23 of slot 29 in the female insert receiver portion 17, the contacting surfaces 23 and 43, in combination with the rivet 41 providing a secure and tight fit for the spade cutting insert 33 into the female insert receiver portion 17.

Figure 4:
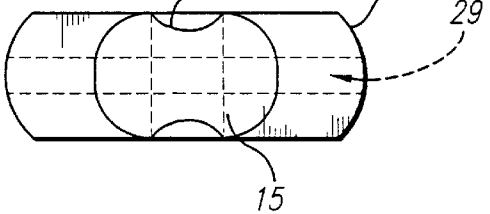
FIG. 4 is a top plan view of the female body and shank portion shown in FIG. 2.
Figure 2:
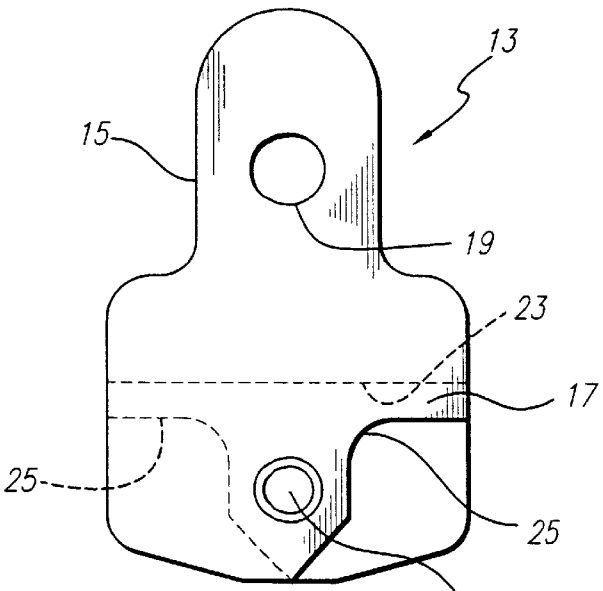
FIG. 2 is a front elevational view of a female body and shank portion of a preferred embodiment of the invention.

By reference to FIG. 4, it will be appreciated that the shank portion 15 of the embodiment of FIG. 2 may have channels 31 formed on each side, whereby fluid may be passed, or a vacuum may be provided for the removal of dust and small particles from the material or substance being cut.

Figure 6:
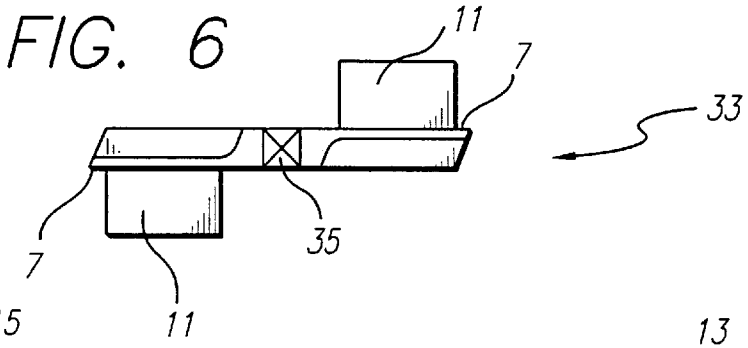
FIG. 6 is a bottom view of the spade insert shown in FIG. 5 but without rotatable frusto conical cutters mounted on the bosses shown in the figure.
Figure 7:
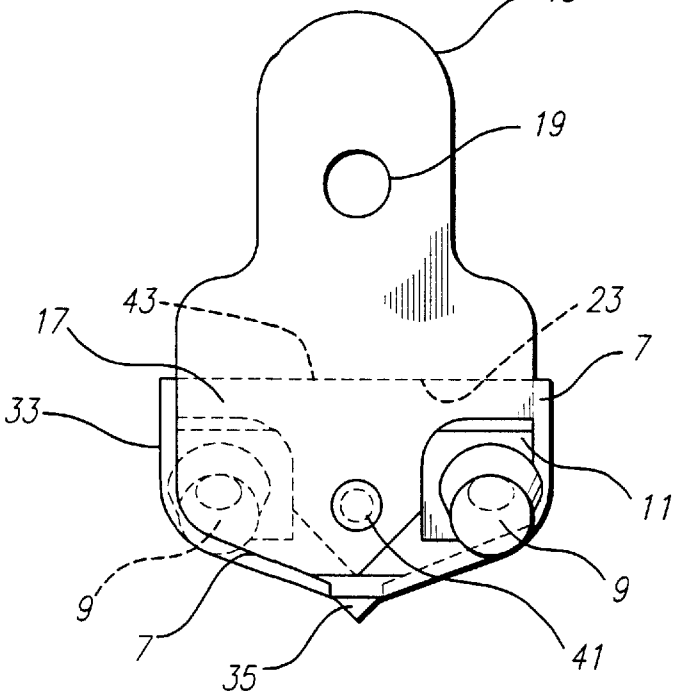
FIG. 7 is a front elevational view similar to that shown in FIG. 2, but with a spade insert received by and fixed to the female body and shank portion.

As will be observed by reference to FIG. 7, the outer lateral edges and the bottom of the spade cutting insert 33 are provided with sharp cutting edges for the rotary spade drill arrangement. Where the converging, substantially radial cutting edges 7 meet at the bottom central region of the spade cutting insert 33, as shown in FIGS. 5–8, a pyramidal-shaped point 35 is formed. This may best be viewed in FIG. 6 showing the bottom view of the spade cutting insert 33. The shape of the pyramidal point 35 provides four cutting edges, as opposed to the typical spade drill cutter inserts which have only one or two cutting surfaces. A pyramidal-shaped end point 35 thus provides advantages over one-edge or two-edge points of the prior art, by at least doubling the impact frequency and cutting/drilling efficiency of the tip in a starting hole, and by subjecting any particular cutting edge to the material or substance to be cut with greatly reduced stress.

Figure 8:
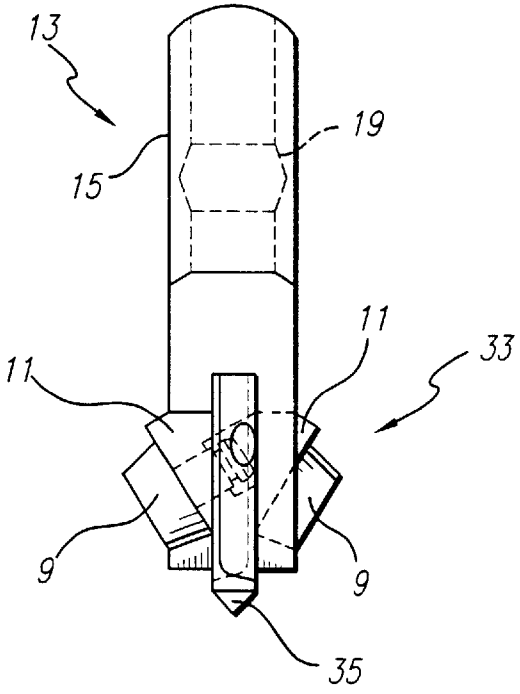
FIG. 8 is a side elevational view of the arrangement shown in FIG. 7.
Figure 11:
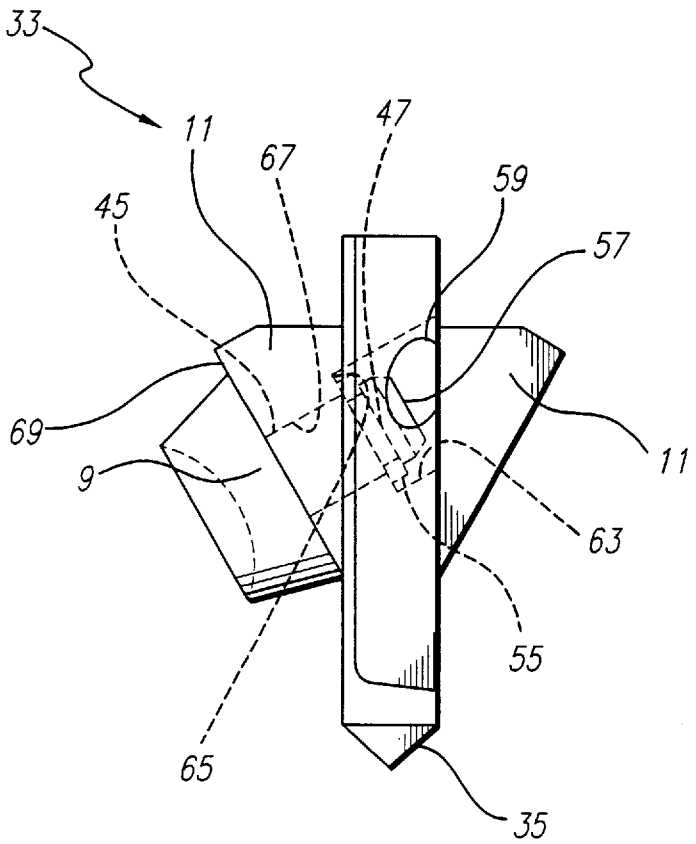
FIG. 11 is a side elevational view of the spade cutting insert shown in FIG. 5 with one of the rotatable frusto conical cutters mounted in position, illustrating the mounting and release features of the invention.
Figure 10:
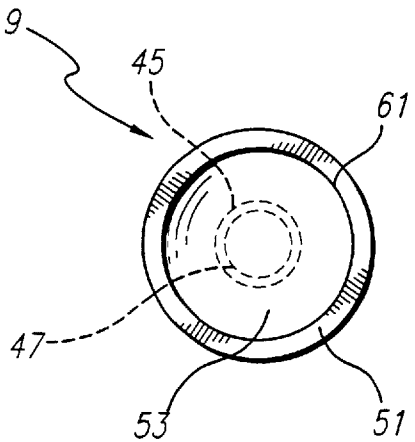
FIG. 10 is a left side view of the rotatable frusto conical cutter of FIG. 9, showing the cutting end of the frusto conical cutter.
Figure 9:
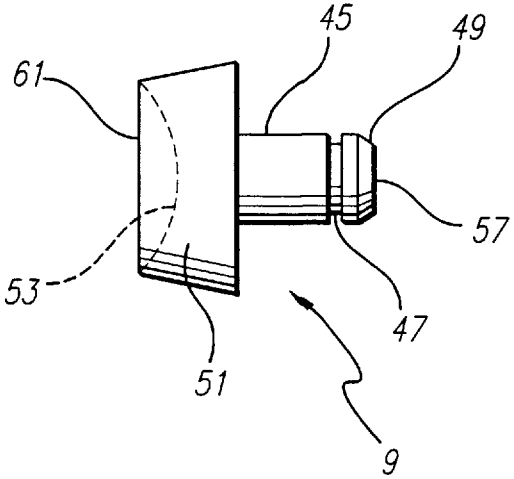
FIG. 9 is a side view of a rotatable frusto conical cutter which is to be mounted on the spade cutting insert shown in FIG. 5.

FIG. 8 is a side elevation view of the completely assembled rotary spade drill arrangement of FIG. 7, showing the downward angle of the rotatable frusto conical cutter insert 9, the shape of the bosses or platforms 11, and the orientation of the shaft of the rotatable frusto conical cutter insert 9, further details of which may be better understood by reference to FIGS. 9–11.

FIG. 9 is a side view of a rotatable frusto conical cutter insert 9 having a frusto conical nose portion 51 tapering forwardly to a cutting edge 61 formed by the converging surfaces of the outer surface of frusto conical surface 51 and the concave cutter face 53. Extending rearwardly from the center of the nose portion 51 is a shaft 45 having a chamfered end 49 and an intermediate retainer ring groove 47 adjacent the end 49.

FIG. 10 is a view taken from the left side of FIG. 9 showing the front of the frusto conical cutter insert.

The nose portion of the frusto conical cutter insert may have formed therein sharp-edged grooves or flutes (not shown). Such sharp-edged grooves or flutes aid in chipping away the material or substance being cut by the cutting insert, in providing breaking of chips in metal removal, in moving small particles away from the cutting/drilling process, and in providing forced rotation of rotary cutting inserts. It is to be understood that the design of the frusto conical cutter inserts shown in the accompanying figures are for illustrative purposes only, and any of a variety of patterns of sharp cutting edges on the cutting insert faces can be formed, as desired. For example, instead of V-grooves, facial sharp edges for the cutting insert may be formed as boss projections, diamond shaped grooves, radial grooves, axially angular grooves, helical grooves, tapered grooves, or grooves in a feathered pattern or in a chevron pattern, any such grooves being straight or curved as desired, to name a few.

FIG. 11 is a somewhat enlarged view of just the spade cutting insert 33 shown in FIG. 8. A cylindrical bore 67 is formed in the boss or platform 11 for accommodating shaft 45 for rotation therein. An access hole 63, larger in diameter than cylindrical bore 67, is formed from the rear of the spade cutting insert 33 so as to have access to a retainer ring 55 (e.g. a snap ring), thereby defining an annular shoulder 65. The outer cylindrical surface of shaft 45 is provided with an annular groove 47, and the retainer ring 55 is captured in the annular retainer groove 47 against annular shoulder 65 to fix the rotatable frusto conical cutter insert 9 axially with respect to the spade cutting insert 33. As seen in FIG. 9, the chamfered end 49 of shaft 45 is effective to spread the retainer ring 55 radially outwardly, upon installation of a retainer ring 55 onto a fresh frusto conical cutter 9, until the retainer ring 55 snaps into annular groove 47, completing the installation of the cutter insert 9.

The sloped surface of platform 11 provides a planar thrust bearing surface for the rear of frusto conical nose 51 of the cutter insert 9. Preferably, the contacting bearing surfaces are treated with a diamond coating, available from QQC, Inc. of Dearborn Mich., to reduce the sliding friction between the mating conical surfaces.

When a different cutter insert 9 is required, or when cutter insert 9 needs to be removed for sharpening and/or replacement, the spade cutting insert 33 may be removed from shank member 13, and a retainer ring removal tool (not shown) may be inserted in the access hole 63 from the rear of shaft 45. After spreading the retainer ring sufficiently, the cutter insert 9 may be easily removed. Alternatively, especially if the rear edges of annular groove 47 are chamfered or beveled slightly, the cutter insert 9 may be removed by prying the nose portion 51 away from the sloped surface 69 of platform 11 without requiring removal of the spade cutting insert 33 from shank member 13. A more convenient way of snapping the cutter insert 9 from retention by the retainer ring 55 (again, without requiring removal of the spade cutting insert 33 from shank member 13) is to push the inner end of shaft 45 outwardly with a tool. Toward that end, an opening 59 may be provided in each lateral edge of the spade cutting insert 33, forming a passageway directly leading to the center of the rear surface 57 of shaft 45. A mating access hole (not shown) in the body of shank member 13, in alignment with opening 59 of the spade cutting insert 33, may be provided for insert removal, if needed. In a fully assembled rotary drill arrangement, the right side of the spade cutting insert 33 shown in FIG. 11 bears against an inner sidewall surface of the slot 29 formed in insert receiver portion 17. Accordingly, a tool inserted in opening 59, especially if wedge-shaped at its tip, applies a wedging pressure between the shaft end 57 and the inner wall surface of the slot 29. Sufficient wedging force will urge the shaft 45 forwardly out of the capturing effects of the retainer ring 55.

In the embodiments shown and described, it was suggested that the sloped platforms 11 were integrally formed with the blade cutting portion of the spade cutting inserts 33. Obviously, other means of supporting a rotatable frusto conical cutting insert 9 than the platforms 11 as shown would come to the mind of a skilled worker, once the need for such platform is made known. That is, to conserve the hardened material used for forming the spade cutting inserts 33, less expensive metal platforms, made independently of the insert 33, can be welded, riveted, brazed, screwed, or otherwise mounted securely thereon.

Moreover, various methods may be utilized to retain the spade cutting insert 33 in the female insert receiver portion 17, other than by the rivet 41 shown and described in connection with the preferred embodiment. For example, the insert 33 may be fixedly attached to a body and shank member 13 by means of screws, retainer pins, or by means of a taper locking fit between the spade cutting insert 33 and the slot 29 for receiving the spade cutting insert. Such a taper lock system is described in my copending application entitled "TAPER LOCK ARRANGEMENT", filed simultaneously herewith and bearing Ser. No. 08/905,038.

It will also be understood that the various features of the invention described in connection with a rotary spade drill arrangement employing replaceable rotatable frusto conical cutter inserts have novel and nonobvious characteristics of their own. Accordingly, these features of the invention are to be considered independently inventive from the rotary drill arrangements employing rotatable frusto conical cutter inserts. For example, it has heretofore been unknown to provide a pyramidal merging point for the sloping, generally radially directed, cutting edges of a spade drill or spade cutting insert. Similarly, removing retainer ring locked shafts from their retainer rings in the annular grooves of mating cylindrical components by providing a tool access hole for the insertion of a wedged tool to force the locked shaft out of locking engagement with the retainer ring is also an independent invention of merit.

While only certain embodiments have been set forth, alternative embodiments and various modifications will be apparent from the above description to those skilled in the art. These and other alternatives are considered equivalents and within the spirit and scope of the present invention.

What is claimed is:

1. A rotary spade drill arrangement, comprising:

a spade drill body having a rotational axis, a shank portion, and a generally planar spade cutter portion with a pair of oppositely directed cutting edges extending radially of said axis; and a rotatable frusto conical cutter mounted on said spade cutter portion adjacent the maximum radial extent of each of said cutting edges, and said rotatable frusto conical cutter having a cutting edge at a narrow end thereof and said narrow end of said frusto conical cutter facing away from said rotational axis.

2. The rotary spade drill arrangement as claimed in claim 1, wherein each of said rotatable frusto conical cutters has an axis and said cutting edge is a coaxial circular cutting edge, the zero plane of said frusto conical cutter cutting edges being coincident with the plane containing the cutting paths of said spade cutter portion cutting edges adjacent said maximum radial extent of said spade cutter portion cutting edges.

3. The rotary spade drill arrangement as claimed in claim 1, wherein:

said spade drill body shank portion comprises a shank part and a spade cutting insert receiver part; and said spade cutter portion defines a separate spade cutting insert receivable in said spade cutting insert receiver part.

4. The rotary spade drill arrangement as claimed in claim 3, comprising a fastening means removably attaching said spade cutting insert to said spade cutting insert receiver part.

5. The rotary spade drill arrangement as claimed in claim 4, wherein said spade cutting insert receiver part is U-shaped with parallel legs straddling said spade cutting insert, each said leg having a side cutout portion through which one of said rotatable frusto conical cutters which is mounted on said spade cutting insert projects.

6. The rotary spade drill arrangement as claimed in claim 5, wherein:

said spade cutting insert has side cutting edges; and said cutting edges extending radially of said spade drill cutter portion and said side cutting edges extend beyond adjacent portions of said spade cutting insert receiver part.

7. The rotary spade drill arrangement as claimed in claim 3, wherein each of said rotatable frusto conical cutters has an axis and said cutting edge is a coaxial circular cutting edge, the zero plane of said frusto conical cutter cutting edges being coincident with the plane containing the cutting paths of said spade cutter portion cutting edges adjacent said maximum radial extent of said spade cutter portion cutting edges.

8. The rotary spade drill arrangement as claimed in claim 1, wherein said spade cutting insert comprises a pyramidal point at the intersection of said cutting edges of said spade cutter portion.

9. A rotary spade drill arrangement, comprising:

a spade drill body having a rotational axis, a shank portion, and a generally planar spade cutter portion with a pair of oppositely directed cutting edges extending radially of said axis; and a rotatable frusto conical cutter mounted on said spade cutter portion adjacent the maximum radial extent of each of said cutting edges, wherein each of said rotatable frusto conical cutters has an axis and a coaxial circular cutting edge, the zero plane of said frusto conical cutter cutting edges being coincident with the plane containing the cutting paths of said spade cutter portion cutting edges adjacent said maximum radial extent of said spade cutter portion cutting edges, and wherein each of said frusto conical cutter axis lies in a plane parallel to said spade drill body rotational axis and depends from the general plane of said spade cutter portion at an angle selected to provide a predetermined axial rake or said frusto conical.

10. The rotary spade drill arrangement as claimed in claim 9, wherein said spade cutter portion comprises a pair of projecting platforms on opposite sides thereof upon which said rotatable frusto conical cutters are rotatably mounted.

11. The rotary spade drill arrangement as claimed in claim 10, wherein:

each of said platforms has a flat sloping surface angled from said general plane of said spade cutter portion to place the cutting edges of said frusto conical cutter at said predetermined axial rake; and each of said frusto conical cutter axis is perpendicular to said platform flat sloping surface.

12. The rotary spade drill arrangement as claimed in claim 11, wherein said flat sloping surface defines a planar thrust bearing surface for said rotatable frusto conical cutter.

13. A rotary spade drill arrangement, comprising:

a spade drill body having a rotational axis, a shank portion, and a generally planar spade cutter portion with a pair of oppositely directed cutting edges extending radially of said axis; and a rotatable frusto conical cutter mounted on said spade cutter portion adjacent the maximum radial extent of each of said cutting edges, wherein each of said rotatable frusto conical cutters has an axis, and a forwardly directed coaxial circular cutting edge, and a rearwardly directed shaft;

said spade cutter portion has a pair of bores on opposite sides thereof for receiving the shafts of corresponding rotatable frusto conical cutters; and said rotary spade drill arrangement comprises an axial retainer for retaining each of said frusto conical cutter shafts in its corresponding bore.

14. The rotary spade drill arrangement as claimed in claim 13, wherein each of said axial retainers is accessible for releasing retention of its corresponding frusto conical cutter shaft, whereby a rotatable frusto conical cutter may be removed and replaced by another rotatable frusto conical cutter.

15. The rotary spade drill arrangement as claimed in claim 13, wherein:

each of said frusto conical cutter shafts has a rear distal end provided with an annular groove adjacent said rear distal end;

each of said bores has an annular groove therein; and each of said axial retainer is a locking ring sitting within said frusto conical cutter shaft annular groove and said bore annular groove.

16. The rotary spade drill arrangement as claimed in claim 15, wherein said rear distal end of said frusto conical cutter shaft is chamfered, whereby pushing said frusto conical cutter shaft into said bore spreads said locking ring, permitting said frusto conical cutter shaft to pass therethrough until said locking ring locks into said shaft groove.

17. A rotary drill arrangement, comprising:

a drill body having a rotational axis, a shank portion, and a cutter portion with a pair of cutting edges extending radially of said axis; and a rotatable frusto conical cutter mounted on said cutter portion adjacent the maximum radial extent of each of said cutting edges, and said rotatable frusto conical cutter having a cutting edge at a narrow end thereof and said narrow end of said frusto conical cutter facing away from said rotational axis.

* * * * *